US008058191B2

(12) United States Patent
Campbell

(10) Patent No.: US 8,058,191 B2
(45) Date of Patent: Nov. 15, 2011

(54) MULTILAYERED CERAMIC MATRIX COMPOSITE STRUCTURE HAVING INCREASED STRUCTURAL STRENGTH

(75) Inventor: Christian X. Campbell, Orlando, FL (US)

(73) Assignee: Siemens Energy, Inc., Orlando, FL (US)

( * ) Notice: Subject to any disclaimer, the term of this patent is extended or adjusted under 35 U.S.C. 154(b) by 530 days.

(21) Appl. No.: 12/204,092

(22) Filed: Sep. 4, 2008

(65) Prior Publication Data

US 2010/0056006 A1 Mar. 4, 2010

(51) Int. Cl.
*B32B 5/26* (2006.01)
*D03D 11/00* (2006.01)

(52) U.S. Cl. ..... 442/255; 442/205; 442/239; 442/246; 264/258; 156/278

(58) Field of Classification Search ..... 442/205, 442/239, 246, 255; 264/258; 156/278
See application file for complete search history.

(56) References Cited

U.S. PATENT DOCUMENTS 3,808,087 A 4/1974 Milewski et al.
5,433,777 A 7/1995 Sheppard
5,451,448 A 9/1995 Sawko et al.
5,691,054 A 11/1997 Tennent et al.
5,939,216 A 8/1999 Kameda et al.
6,418,973 B1 * 7/2002 Cox et al. ..... 139/383 R
6,617,013 B2 9/2003 Morrison et al.
6,818,288 B2 11/2004 Bauer et al.
7,118,802 B2 10/2006 Simon et al.
7,153,096 B2 12/2006 Thompson et al.
7,153,464 B2 12/2006 Millard et al.
7,223,465 B2 5/2007 Subramanian et al.
7,258,530 B2 8/2007 Morrison et al.
7,300,621 B2 11/2007 Merrill
2002/0006506 A1 1/2002 Hanzawa et al.
2004/0247845 A1 12/2004 Abe et al.
2005/0146076 A1 * 7/2005 Alexander et al. ..... 264/257
2005/0186878 A1 8/2005 Kostar et al.
2006/0284337 A1 12/2006 Subramanian et al.

* cited by examiner

*Primary Examiner* — Norca L Torres Velazquez

(57) ABSTRACT

A multilayer ceramic matrix composite structure is disclosed. The ceramic matrix composite structure may include a three-dimensional weave fabric forming a core layer. The ceramic matrix composite structure may also include a two-dimensional weave fabric attached to an outer top surface of the three-dimensional weave fabric such that the two-dimensional weave fabric forms a top layer, and a two-dimensional weave fabric attached to an outer bottom surface of the three-dimensional weave fabric generally opposite to the outer top surface such that the two-dimensional weave fabric forms a bottom layer. The structure may include increased interlaminar shear strength.

12 Claims, 1 Drawing Sheet

MULTILAYERED CERAMIC MATRIX COMPOSITE STRUCTURE HAVING INCREASED STRUCTURAL STRENGTH

FIELD OF THE INVENTION

The present invention relates to ceramic matrix composite structures, and more particularly, to ceramic matrix composite structures that are used within turbine engines.

BACKGROUND OF THE INVENTION

Parts made from ceramic matrix composite (CMC) materials permit higher operating temperatures than do metal alloy materials due to the inherent nature of ceramic materials. High temperature environments such as state of the art turbine engines require such materials. This high temperature capability translates into reduced cooling requirements, resulting in higher power, greater efficiency, and reduced emissions from the machine. Conventional CMC components formed from two-dimensional fiber arrangements have sufficient in-plane, bending strength, but often lack sufficient in-plane shear stress strength to carry stress loads from backside pressure loads.

SUMMARY OF THE INVENTION

A ceramic matrix composite structure (CMC structure) having increased strength properties is disclosed. The CMC structure may be formed from a collection of materials configured to provide increased interlaminar shear strength and superior bending strength relative to conventional monolithic CMC structures. In particular, the CMC structure may include a three-dimensional weave fabric forming a core layer that is covered with two-dimensional weave fabric layers. The three-dimensional weave fabric forming a core layer has increased interlaminar shear strength, and the two-dimensional weave fabric layers have increased bending strength, thereby increasing the load carrying capacity of the CMC structure when exposed to backside pressure load.

The ceramic matrix composite structure may be formed from a three-dimensional weave fabric forming a core layer, a two-dimensional weave fabric attached to an outer top surface of the three-dimensional weave fabric such that the two-dimensional weave fabric forms a top layer, and a two-dimensional weave fabric attached to an outer bottom surface of the three-dimensional weave fabric generally opposite to the outer top surface such that the two-dimensional weave fabric forms a bottom layer. In at least one embodiment, the thickness of the core layer formed by the three-dimensional weave fabric may be less than about 4 millimeters, the two-dimensional weave fabric that forms the top layer may have a thickness of about 1.5 millimeters, and the two-dimensional weave fabric that forms the bottom layer may have a thickness of about 1.5 millimeters. The Z-fibers forming the three-dimensional weave fabric may extend in a thru-thickness direction and may be substantially straight.

An advantage of the CMC structure is that the three-dimensional core layer has increased in-plane strength and can therefore carry increased amounts of interlaminar shear stress.

Another advantage of the CMC structure is that the two dimensional outer layers have increased bending strength relative to the three-dimensional core layer because of a higher fiber volume content.

These and other components may be described in more detail below.

DETAILED DESCRIPTION OF THE INVENTION

Figures 1, 2:
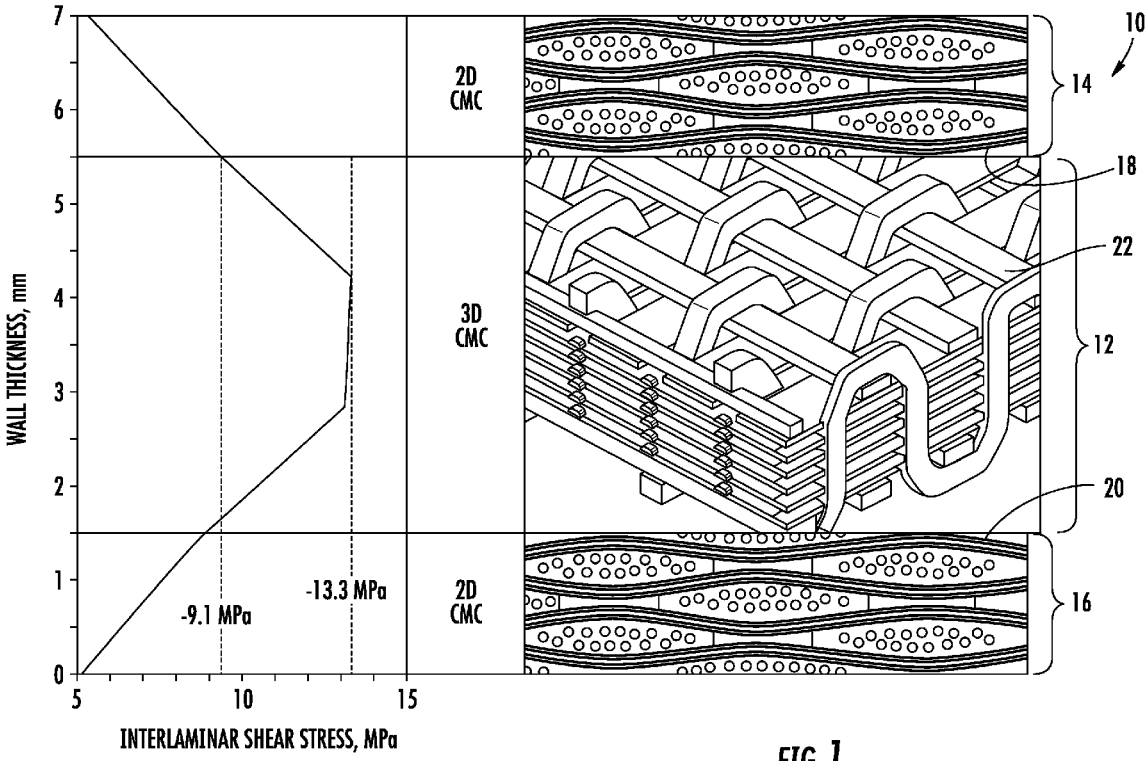
FIG. 1 is a schematic diagram illustrating the CMC structure formed from a three-dimensional core layer with outer two-dimensional CMC layers.
FIG. 2 is a graph of interlaminar sheer stress at locations across a thickness of a CMC structure.

As shown in FIGS. 1-2, a ceramic matrix composite structure 10 (CMC structure) having increased strength properties is disclosed. The CMC structure 10 may be formed from a collection of materials configured to provide increased interlaminar shear strength and superior bending strength relative to conventional monolithic CMC structures. In particular, the CMC structure 10 may include a three-dimensional weave fabric forming a core layer 12 that is covered with two-dimensional weave fabric layers 14, 16. The three-dimensional weave fabric forming a core layer 12 has increased interlaminar shear strength, and the two-dimensional weave fabric layers 14, 16 have increased bending strength.

As shown in FIGS. 1 and 2, the CMC structure 10 may be formed from the three-dimensional weave fabric forming a core layer 12. The three-dimensional weave fabric may be any appropriate CMC fabric having components extending in an X, Y, and Z direction. The three-dimensional weave fabric may be drapable such that it is capable of being co-processed with the two-dimensional weave fabric layers 14, 16 and able to conform to the shape of the two-dimensional weave fabric layers 14, 16. The three-dimensional weave fabric may also be compressible such that the three-dimensional weave fabric may be subjected to consolidation pressure without damaging the fibers or creating too much springback such that the three-dimensional weave fabric does not have enough springback to destroy the matrix in the green state.

The core layer 12 may be positioned between a two-dimensional weave fabric top layer 14 and a two-dimensional weave fabric bottom layer 16. The thickness of the core layer 12 formed by the three-dimensional weave fabric is less than about four millimeters. Thicknesses greater than four millimeters are difficult to create. Z-fibers 22 forming the three-dimensional weave fabric 12 may extend in a thru-thickness direction and may be substantially straight.

The two-dimensional weave fabric top layer 14 may be attached to an outer top surface 18 of the three-dimensional weave fabric 12 such that the two-dimensional weave fabric forms a top layer. The two-dimensional weave fabric bottom layer 16 may be attached to an outer bottom surface 20 of the three-dimensional weave fabric generally opposite to the outer top surface 18 such that the two-dimensional weave fabric forms a bottom layer. In one embodiment, the two-dimensional weave fabric layer 14 that forms the top layer may have a thickness of about 1.5 millimeters. In other embodiments, the two-dimensional weave fabric layer 14 may have other thicknesses. Similarly, the two-dimensional weave fabric 16 that forms the bottom layer may have a thickness of about 1.5 millimeters. In such an embodiment, the combined thickness of the CMC structure 10 may be about seven millimeters. In other embodiments, the two-dimensional weave fabric layer 16 may have other thicknesses.

The CMC structure 10 may form a generally flat structure. In other embodiments, the CMC structure 10 may be formed from other shapes. The CMC structure 10 may be formed by a method of forming a ceramic matrix composite structure 10. The method may include providing a two-dimensional preform of a weave fabric. Each layer of fabric may be infiltrated separately and layed up on tooling with a desired shape and configuration. The layer may be consolidated to form a composite by, for instance, enclosing the layer within a vacuum bag and consolidating the CMC at less then 300 degrees Fahrenheit and less than 100 pounds per square inch. By infiltrating each layer separately, there is no thickness limitation caused by infiltration limitations.

The method may also include providing a three-dimensional preform of a weave fabric to form a core layer 12 to conform with a two-dimensional weave fabric. The three-dimensional preform can be fabricated and formed into a composite material. To form an oxide/oxide ceramic matrix composite (CMC), the three-dimensional preforms may be infiltrated with a ceramic powder slurry. Effective infiltration can be achieved for this cross-sections, such as less than 2 millimeters thick. However, as the wall thickness increases, infiltration of the 3D architecture becomes increasingly difficult. Essentially, the three dimensional perform acts as a filter, removing the ceramic powder from the slurry, so that the center portion of the composite is not infiltrated. Wall thicknesses of greater than four millimeters are very difficult to infiltrate.

The two-dimensional preform may be attached to a top surface of the three-dimensional preform. A two-dimensional preform of a weave fabric may be provided for a bottom layer. The two-dimensional preform for a bottom layer may be infiltrated, laid on tooling and consolidated. The two-dimensional preform for a bottom layer may be attached to a bottom surface of the three-dimensional preform to form a bottom layer. The top layer, core layer, and bottom layer may be consolidated to form the ceramic matrix composite structure.

The method of forming a ceramic matrix composite structure 10 may include providing the two-dimensional preform of a weave fabric with Z-fibers extending in a thru-thickness direction that are substantially straight. Providing the three-dimensional and two-dimensional preforms may include providing the three-dimensional preform having a thickness of about 4 millimeters, providing the two-dimensional weave fabric that forms the top layer having a thickness of about 1.5 millimeters, and providing the two-dimensional weave fabric that forms the bottom layer having a thickness of about 1.5 millimeters.

During use, the two-dimensional top and bottom layers 14, 16 have increased bending strength and stiffness relative to the three-dimensional core layer 12. In addition, the three-dimensional core layer 12 has increased interlaminar shear strength relative to the two-dimensional top and bottom layers 14, 16. The interlaminar shear strength of the CMC structure 10 controls the amount of backside pressure load that the CMC structure 10 can carry. The greatest amount of shear stress in the CMC structure 10 is located at the center. Because the three-dimensional core layer 12 can carry higher interlaminar shear stress, the CMC structure 10 is able to be exposed to larger backside pressure loads without failure occurring.

In one situation, peak interlaminar shear stress in a laminated portion of a 2D-3D-2D structure may be about 9.1 MPa. In contrast, the peak interlaminar shear stress at the center of a conventional 2D CMC structure may be about 13.3 MPa. Therefore, the 2D-3D-2D structure has about 30 percent greater pressure load carrying capacity.

While the preferred embodiments of the invention have been illustrated and described, it will be clear that the invention is not so limited. Numerous modifications, changes, variations, substitutions and equivalents will occur to those skilled in the art without departing from the spirit and scope of the present invention as described in the claims.

I claim:

1. A ceramic matrix composite structure, comprising:

a three-dimensional weave fabric forming a core layer, wherein the three-dimensional weave fabric is formed from a ceramic matrix composite fabric having components extending in an X, Y, and Z directions;

a two-dimensional weave fabric attached to an outer top surface of the three-dimensional weave fabric such that the two-dimensional weave fabric forms a top layer; and a two-dimensional weave fabric attached to an outer bottom surface of the three-dimensional weave fabric generally opposite to the outer top surface such that the two-dimensional weave fabric forms a bottom layer.

2. The ceramic matrix composite structure of claim 1, wherein the thickness of the core layer formed by the three-dimensional weave fabric is less than about 4 millimeters.

3. The ceramic matrix composite structure of claim 2, wherein the two-dimensional weave fabric that forms the top layer has a thickness of about 1.5 millimeters.

4. The ceramic matrix composite structure of claim 3, wherein the two-dimensional weave fabric that forms the bottom layer has a thickness of about 1.5 millimeters.

5. The ceramic matrix composite structure of claim 1, wherein Z-fibers forming the three-dimensional weave fabric extend in a thru-thickness direction and are substantially straight.

6. The ceramic matrix composite structure of claim 1, wherein the thickness of the core layer formed by the three-dimensional weave fabric is about 4 millimeters, the two-dimensional weave fabric that forms the top layer has a thickness of about 1.5 millimeters, and the two-dimensional weave fabric that forms the bottom layer has a thickness of about 1.5 millimeters.

7. A method of forming a ceramic matrix composite structure, comprising:

providing a two-dimensional preform of a weave fabric;

infiltrating the two-dimensional preform, laying the two-dimensional preform on tooling and consolidating the two-dimensional preform;

providing a three-dimensional preform of a weave fabric to form a core layer to conform with a two-dimensional weave fabric, wherein the three-dimensional preform is formed from components extending in an X, Y, and Z directions;

infiltrating the three-dimensional preform with a ceramic powder slurry;

attaching the two-dimensional preform to a top surface of the three-dimensional preform;

providing a two-dimensional preform of a weave fabric for a bottom layer;

infiltrating the two-dimensional preform for a bottom layer, laying the two-dimensional preform on tooling and consolidating the two-dimensional preform;

attaching the two-dimensional preform for a bottom layer to a bottom surface of the three-dimensional preform to form a bottom layer; and consolidating the top layer, core layer, and bottom layer to form the ceramic matrix composite structure.

8. The method of claim 7, wherein providing the three-dimensional preform comprises providing the three-dimensional preform having a thickness less than about 4 millimeters.

9. The method of claim 8, wherein providing the two-dimensional preform that forms the top layer comprises providing the two-dimensional preform having a thickness of about 1.5 millimeters.

10. The method of claim 9, wherein providing the two-dimensional preform that forms the bottom layer comprises providing the two-dimensional preform having a thickness of about 1.5 millimeters.

11. The method of claim 7, wherein providing the two-dimensional preform of a weave fabric comprises providing the two-dimensional preform of a weave fabric with Z-fibers extending in a thru-thickness direction that are substantially straight.

12. The method of claim 7, wherein providing the three-dimensional preform forming the core layer comprises providing the three-dimensional preform having a thickness of about 4 millimeters, wherein providing the two-dimensional weave fabric that forms the top layer comprises providing the two-dimensional weave fabric that forms the top layer having a thickness of about 1.5 millimeters, and wherein providing the two-dimensional weave fabric that forms the bottom layer comprises providing the two-dimensional weave fabric that forms the bottom layer having a thickness of about 1.5 millimeters.

* * * * *